US005983432A

United States Patent [19]

Jones

[11] Patent Number: 5,983,432

[45] Date of Patent: Nov. 16, 1999

[54] MULTIGOLF CLEANER

[76] Inventor: Nathan Jones, 6243 Aberdeen St., Dallas, Tex. 75230

[21] Appl. No.: 09/092,835

[22] Filed: Jun. 5, 1998

[51] Int. Cl.[6] ..... A63B 47/04

[52] U.S. Cl. ..... 15/21.2; 15/104.92; 15/160; 134/201; 206/209.1; 206/579; 220/23.2; 211/70.2; 401/17

[58] Field of Search ..... 15/21.2, 104.92, 15/160; 134/84, 89, 92, 201; 206/209.1, 229, 315.9, 579; 220/505, 507, 553, 23.2, 23.83; 211/70.2; 401/9, 10, 17, 131, 139; 473/131, 282, 406–408

[56] References Cited

U.S. PATENT DOCUMENTS

| | | | |
|---|---|---|---|
| 2,617,132 | 11/1952 | Goller | 15/21.2 |
| 3,062,422 | 11/1962 | Lord | 206/579 X |
| 3,101,497 | 8/1963 | Derkocz | 15/21.2 |
| 3,156,000 | 11/1964 | Westhoff | 15/104.92 |
| 3,271,802 | 9/1966 | Thompson | 15/21.2 |
| 3,400,416 | 9/1968 | Nicholson et al. | 15/21.2 |
| 3,748,676 | 7/1973 | Warren et al. | 15/21.2 |
| 4,344,203 | 8/1982 | Gerrick | 15/21.2 |
| 4,945,596 | 8/1990 | Chang et al. | 15/21.2 |
| 4,958,396 | 9/1990 | Butler et al. | 15/21.2 |
| 4,965,906 | 10/1990 | Mauro | 15/104.92 |
| 4,974,763 | 12/1990 | Widrig | 224/666 |
| 5,572,761 | 11/1996 | Meyer | 15/21.2 |

*Primary Examiner*—Mark Spisich
*Attorney, Agent, or Firm*—Mark W. Handley

[57] ABSTRACT

A portable, multigolf cleaner is provided having an enclosure which includes several fluid reservoirs for containing separate cleaning fluids for cleaning different types of golf equipment. The enclosure has three openings through which cleaning utensils are inserted into the cleaning fluids. The cleaning utensils have integral threaded caps for sealing respective ones of the three openings. Two of the cleaning utensils have integral cleaning brushes which are immersed in the cleaning fluids stored in respective ones of the reservoirs. The cleaning brushes have cleaning brush bristles of various stiffness and coarseness, for cleaning the different types of golf equipment. A third cleaning utensil is a ball washing fixture which is used for retaining a ball for reciprocation within a third one of the fluid reservoirs. The third fluid reservoir has a plurality of brush bristles mounted interiorly therein, which face radially inward into the reservoir for scrubbing the golf ball as the golf ball and the golf ball washing fixture are reciprocated within the third reservoir. The enclosure further includes a fourth fluid reservoir which contains water for moistening a cleaning towel.

24 Claims, 4 Drawing Sheets

MULTIGOLF CLEANER

TECHNICAL FIELD OF THE INVENTION

The present is directed toward golf equipment, and, more particularly, to a portable cleaner for cleaning golf equipment.

BACKGROUND OF THE INVENTION

Golf courses and driving ranges almost always have natural turf. This necessitates use of soils and other matter which causes cleanliness problems to arise, especially when moisture is encountered. Golf equipment, such as golf balls, golf clubs and golf shoes are designed to operated properly when surfaces are clean. However, when mud, dirt and other debris attach to golf ball surfaces, golf club faces and golf shoes, the operability of such equipment is adversely affected. For example, golf ball surfaces have dimples across the surface of the ball to improve flight stability and directional control. Club faces are grooved and typically have planar surfaces for impacting the curvilinear surface of golf balls to achieve desired flight results. However, when debris adheres to the surfaces of golf balls and golf club faces, the desired effects on the flight of the ball are adversely affected. Additionally, when excessive mud adheres to golf shoes, the footing of the golfer may be adversely affected such that he may not achieve a proper swing. Golf is also a social event in which appearance and impression are affected by cleanliness, which also may affect the golfer's attitude on the course.

Prior art solutions for cleaning golf equipment on the course have proven unacceptable. For example, golf courses often install ball washer stations at various locations on a golf course. However, the golf balls may become dirty at locations remote from such ball washer stations so that their use is inconvenient. Additionally, these types of ball washer stations have to be re-supplied with fresh water and cleaned to remove debris dislodged from cleaned golf balls.

Golfers often carry towels and a water supply for cleaning golf equipment. A water bottle is often used as a water supply for dampening the towel prior to use. However, the water bottle and towel are typically separately stored, such that each has to be found when a person desires to moisten the towel. Also golf tees are often not readily accessible, and a golfer often has to search through his golf bag to find tees for use.

Prior art cleaning devices have been packaged as portable golf ball cleaners, which include brushes and the like for cleaning golf equipment. However, such devices have not been included in a single convenient unit having a multiplicity of cleaning utensils which, when taken as a unit, could be conveniently used for cleaning golf equipment in most of the various situations which are encountered on a golf course.

SUMMARY OF THE INVENTION

The present invention is directed towards a portable golf cleaner which has an enclosure which includes several fluid reservoirs for containing separate cleaning fluids used to clean different types of golf equipment. The enclosure has three openings through which cleaning utensils are inserted into the cleaning fluids. The cleaning utensils have integral threaded caps for sealing respective ones of the three openings. Two of the cleaning utensils have integral cleaning brushes which are immersed in the cleaning fluids stored in respective ones of the reservoirs. The cleaning brushes have cleaning brush bristles of various stiffness and coarseness, for cleaning different types of golf equipment. A third cleaning utensil is a ball washing fixture which is used for retaining a ball for reciprocation within a third one of the fluid reservoirs. The third fluid reservoir has a plurality of brush bristles mounted interiorly therein, which face radially inwardly into the reservoir for scrubbing the golf ball as the golf ball and the golf ball washing fixture are reciprocated within the third reservoir. The enclosure further includes a fourth fluid reservoir which contains water for moistening a cleaning towel.

In another aspect of the present invention, a mounting bracket is provided for storing a plurality of golf tees therein for easy access to the golfer on the course.

In another aspect of the present invention, a support member is mounted to the enclosure, and includes a through hole for mounting the enclosure to a portable mounting post. The mounting post has a lowermost section with a pointed end for penetrating through turf and into soil beneath the turf. A foot stop laterally extends to the side of the mounting post for a user to press his foot against to insert the lowermost section of the mounting post through the turf and into the soil. The laterally extending foot stop provides a stop once the mounting post is sufficiently pushed into the ground to provide support for the enclosure of the present invention thereon.

In another aspect of the present invention, a towel clip bracket is mounted to the outer surface of the enclosure for engaging a clip which is secured to a towel to secure a towel to the enclosure.

In another aspect of the present invention, a flexible sheet is provided having first and second sides, and a thickness which extends therebetween. Brush bristles are mounted to the sheet such that they extend through the thickness of the sheet and outward from the first side of the flexible sheet. The flexible sheet is formed into a cylindrical shape and inserted within the third fluid reservoir, such that the bristles extend radially inward for scrubbing against the surface of the golf ball.

In a further aspect of the present invention, the flexible sheet having the brush bristles for scrubbing golf balls also has a plurality of spacers which extend radially outward from the second side thereof for spacing the second side of the flexible sheet apart from an inward facing surface of the third fluid reservoir. The thickness of the flexible sheet has a plurality of holes extending therethrough to provide fluid flow passages, such that when the golf ball and the ball washing fixture are reciprocated within the third fluid reservoir, the debris which is dislodged from the golf ball will pass through one of the plurality of holes and into the space between the inward facing surface of the reservoir and the outward facing surface of the second side of the flexible sheet.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
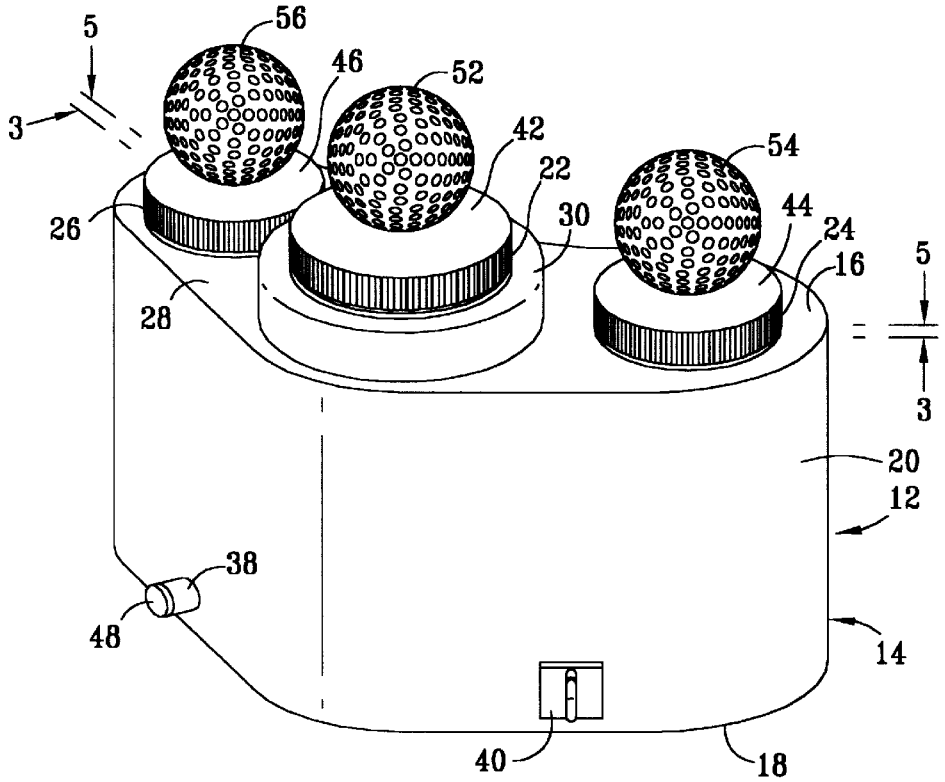
FIG. 1 illustrates a frontal, perspective view of a multigolf cleaner made according to the present invention.

Referring now to FIG. 1, there is illustrated a frontal, perspective view of a portable, multigolf cleaner 12 made according to the present invention. The multigolf cleaner 12 includes an outer enclosure 14 which provides an outer housing for the cleaner 12. The outer enclosure 14 includes a top 16 which defines a flat surface having a continuous, chevron-shaped peripheral edge. The outer enclosure 14 also includes a bottom 18 which defines a flat surface also having a continuous, chevron-shaped peripheral edge. The top 16 is parallel to the bottom 18. A side wall 20 extends from the peripheral edge of the top 16 to the peripheral edge of the bottom 18, and defines the sides of the outer enclosure 14. The sidewall 20 preferably is continuous and has two oppositely facing surface portions which are parallel and extend in curvilinear directions in a horizontal plane, and which have cross-sections which define chevron-shaped profiles when taken in the horizontal plane. The multigolf cleaner 12 further includes container sections 22, 24, 26 and 28 for retaining cleaning fluids therein. The container 22 includes an upwardly protruding portion 30 which extends above the planar surface of the top 16. Threaded rings 32, 34 and 36 (shown in FIG. 3) extend upward above the top 16 to define mounting sections and the tops of container sections 22, 24 and 26, respectively.

A stopper valve fitting 38 extends through the sidewall 20 and provides a fluid connection into the interior of the container section 28. A towel clip bracket 40 is mounted to the exterior of the sidewall 20 on a frontal portion of the multigolf cleaner 12. Caps 42, 44 and 46 provide threaded sealing members which threadingly engage respective ones of the threaded rings 32, 34 and 36 to seal the openings of the container sections 22, 24 and 26, respectively. A stopper valve 48 mounts within the stopper valve fitting 38 to control the flow of a cleaning fluid, preferably water, from within the container section 28. The multigolf cleaner 12 further includes handles 52, 54 and 56 which are rigidly mounted atop respective ones of the caps 42, 44 and 46, and provide a grip means for co-rotating with the caps 42, 44 and 46. Preferably, the handles are shaped to appear as golf balls, and may also be provided in other forms. In other embodiments, grip means may be provided by the exterior surfaces of the caps 42, 44 and 46.

Figure 2:
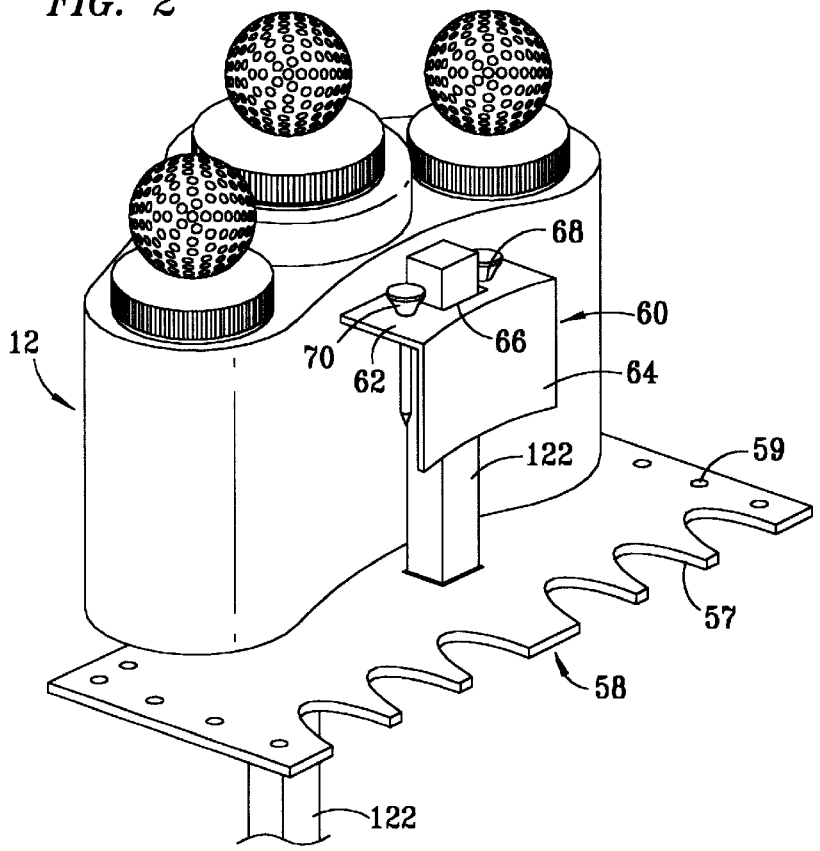
FIG. 2 illustrates a rearward, perspective view of the multigolf cleaner.

Referring now to FIG. 2, there is illustrated a perspective view of the rearward side of the multigolf cleaner 12 and a driving range club holder 58 which have been mounted to a mounting post 122. The mounting post provides a stand for the portable golf club cleaner 12, and is discussed below in more detail. The club holder 58 has notches 57 formed into a side edge thereof, such that the notches 57 provide recesses for resting the upper portion of a club shaft,or a club grip, in each of the notches to support the corresponding club in an upright position. Preferably, six of the notches 57 are provided for supporting six clubs. Twelve holes 59 are provided for receiving golf tees such that the tees will be readily available. An aperture extends through a central section of the club holder member 58 for receiving the mounting post 122, such that a planar upper surface of the club holder member 58 will fit flush with the bottom of the enclosure 14 of the cleaner 12. The club holder 58, when used in combination with the mounting post 122, may be used at a driving range to provide a readily available cleaning station and a stand for supporting practice clubs in an upright position.

Mounted to the rear, backside of the sidewall 20 is a mounting bracket 60. The mounting bracket 60 includes a support member portion 62 and a retaining portion 64. A transverse through hole 66 provides a mounting hole which transversely extends through the retaining portion 62. A plurality of tee retainer holes 68 are also provided to extend through the support member portion 62, with preferably two tee retainer holes 68, each on opposite sides of the hole 66. The tees 70 are passed through the holes 66 and retained in position within the support member 62, such that they will not fall out when jostled. The support member 62 is sized such that the retaining portion 64 will be spaced apart and extend along the sidewall 20, with an adequate distance therebetween for mounting the multigolf cleaner 12 on the rim of golf bag, such that the sidewall 20 is disposed adjacent to and against the outer surface of the golf bag. The retaining portion 62 will be mounted adjacent to and against the rim of the golf bag, with the retaining portion 64 extending downwardly within the golf bag to thereby retain an outer wall of the golf bag between the retaining portion 64 and the sidewall 20. Preferably, the retaining portion 64 has a profile which is shaped such that it extends parallel to an adjacent portion of the sidewall 20, and perpendicular to a downward facing surface of the support member portion 62.

Figure 3:
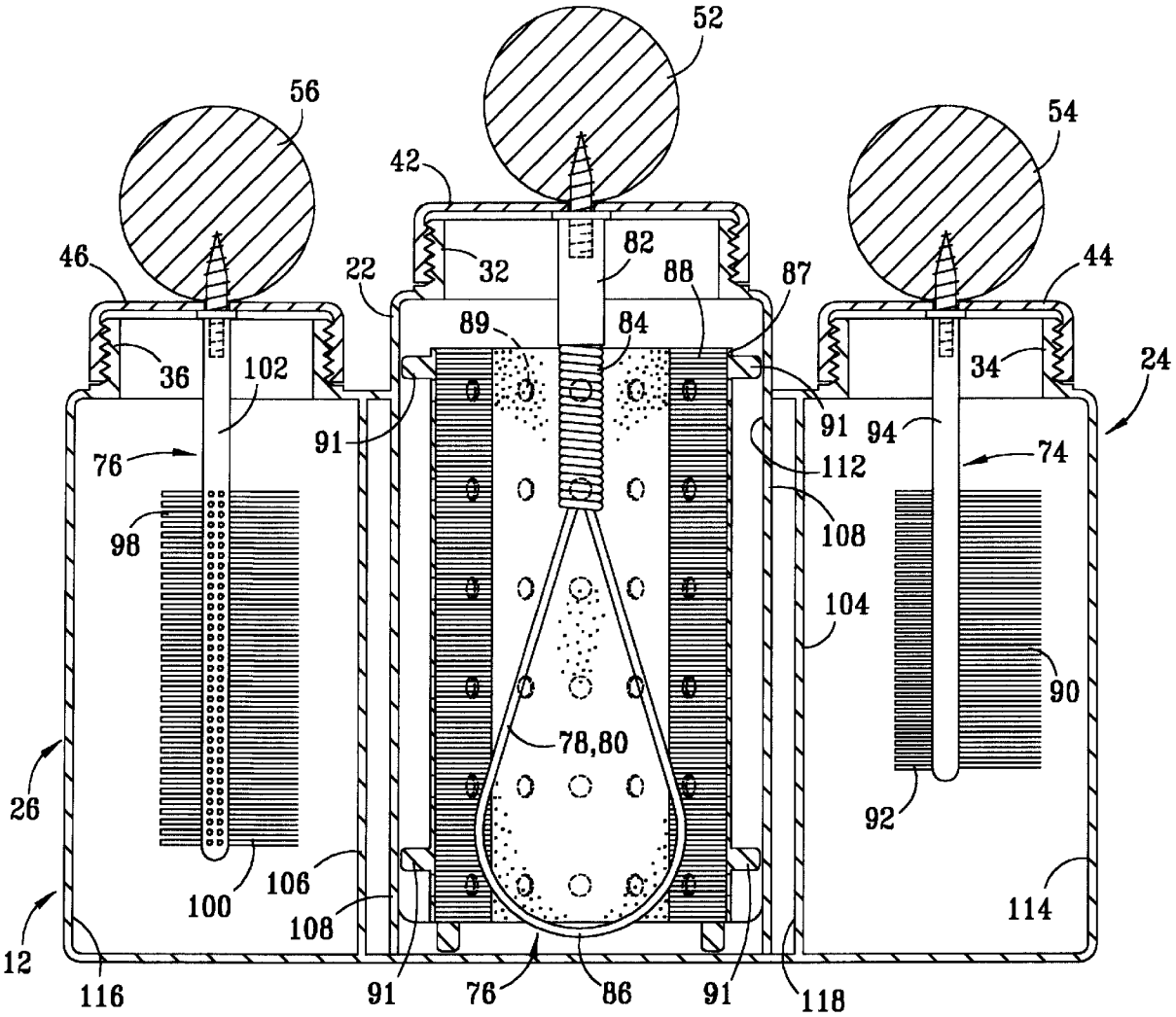
FIG. 3 illustrates a sectional view of the multigolf cleaner taken along Section Line 3—3 of FIG. 1.

Referring now to FIG. 3, there is illustrated a sectional view of the multigolf cleaner 12, taken along section 3—3 of FIG. 1. Various cleaning utensils are disposed within respective ones of the fluid compartment container sections 22, 24 and 26. A ball washing fixture 72 is disposed within the container section 22. A cleaning utensils 74 and 76 are disposed within respective ones of the container sections 24 and 26. The ball washing fixture 72 includes two elongated wire hoops 78 and 80, which extend downward from a stem 82. The stem 82 is rigidly mounted to the cap 42 and the handle 52. The stem 82 is preferably a solid shaft. A sleeve 84 is provided by a coiled spring which is slidable upon the stem 82 between upwards and downwards positions to urge the upper portions of the elongated wire hoops 78 and 80 towards one another, reducing the distance between lower portions 86 of the hoops 78 and 80. Preferably, the lower portions 86 of the elongated wire hoops 78 and 80 are curved such that they have a diameter in the lower portions thereof which is slightly smaller than diameter of a standard size golf ball. Arcuate surface portions of separate sides of a standard size golf ball will be secured within and fit snugly against the lower portions 86 of the elongated wire hoops 78 and 80, such that the golf ball will be rigidly retained within the ball washing fixture 72.

Figure 4:
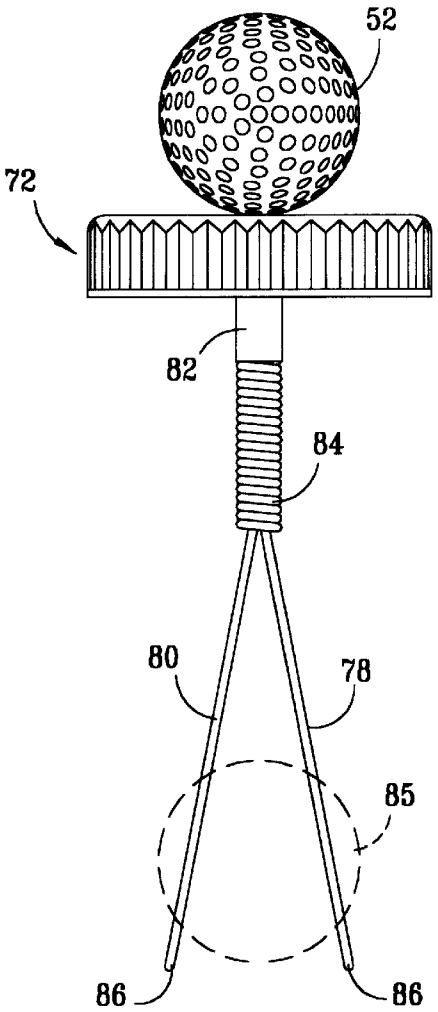
FIG. 4 illustrates a side, elevational view of a golf ball washing fixture of the multigolf cleaner.

Referring now to FIG. 4, there is illustrated a side, elevational view of the ball washing fixture 72 with a golf ball 85 retained therein. The sleeve 84 is moved downward to urge the two hoops 78 and 80 towards one another to engage the lower portions 86 snugly against the exterior surface of the golf ball 85. Thus, the golf ball 85 will be snugly held within the ball washing fixture 72 such that the ball washing fixture 72 may reciprocally moved, upwards and downwards within the container section 22.

Referring again to FIG. 3, a flexible sheet 87 is provided which initially has a flat rectangular shape, and which is be rolled into a cylindrical shape and inserted within container section 22, such that brush bristles 88 extend inwardly therefrom. The brush bristles 88 are mounted to the flexible sheet 87. Additionally, a plurality of fluid flow holes 89 extend through the sheet 87 to allow debris which is dislodged from a golf ball to pass from an inside of the sheet 87, through the holes 89 and to an outward side of the flexible sheet 87. Spacers 91 are provided on the outward side of the flexible sheet 87 to space the outward surface of the flexible sheet 87 apart form the inward facing wall of the container section 22 to provide a particulate trap therebetween.

The ball washing fixture 72 is reciprocated in upwardly and downwardly directions within the container section 22 to urge the golf ball 85 to pass along the brush bristles 88 to clean debris from the surface of the ball 85. Debris will preferably pass through the holes 89 and become entrapped between the flexible sheet 87 and an inward facing surface wall 108 of the container section 22. The debris may be cleaned from the container section 22 by removing the flexible sheet 87 from within the container section 22, and then rinsing the interior of the container section 22.

Still referring to FIG. 3, the cleaning utensil 74 includes brush bristles 90 and brush bristles 92 for cleaning club faces and club surfaces. The brush bristles 90 are disposed on an opposite side of the stem 94 from that on which the brush bristles 92 are mounted. Preferably, the brush bristles 90 are longer and softer than the brush bristles 92, and are used for cleaning club surfaces such as the shafts, heels and handgrips. The brush bristles 92 provide a coarse cleaning brush for cleaning the club faces.

The cleaning utensil 76 is provided for cleaning golf shoes and includes brush bristles 98 and brush bristles 100, which both radially extend from a stem 102. The brush bristles 98 extend for approximately 180.0 degrees around a longitudinal axis of the stem 102. The brush bristles 100 also extend for approximately 180.0 degrees around the longitudinal axis of the stem 102. The brush bristles 98 are shorter, more coarse, and have a firmer stiffness than that of the brush bristles 100. The brush bristles 98 are for cleaning the cleats of golf shoes. The brush bristles 100 are softer for cleaning shoe leather, and the like.

Figure 5:
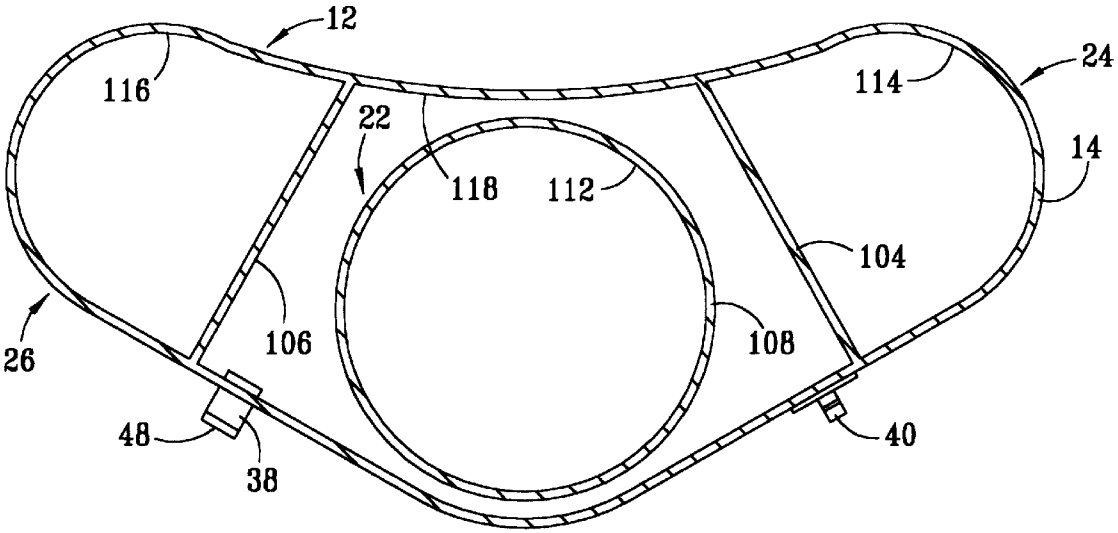
FIG. 5 illustrates a sectional view of the multigolf cleaner taken along Section Line 5—5 of FIG. 1.

Referring now to FIG. 5, there is illustrated a sectional view of the container sections 22, 24, 26 and 28 of the multigolf cleaner 12, taken along Section Line 5—5 of FIG. 1. Partitions 104, 106 and 108 extend interiorly within the outer enclosure 14. The partitions 104 and 106 define interior walls which extend between opposite sections of the sidewall 20. The partition 108 extends to define a cylindrically shaped wall, which is disposed interiorly within the outer enclosure 14, preferably without contacting a portion of the sidewall 20 that defines the container section 22. The partition 108 extends interiorly within the outer enclosure 14, to define a cylindrically shaped container section 22. The container section 22 provides a sealed, fluid reservoir 112. The partition 106 extends between the forward and rearward sides of the sidewall 20, on one side of the outer enclosure 14 to define the container section 26, which defines a sealed, fluid reservoir 116. The partition 104 extends between the forward and rearward portions of the sidewall 20, on one side of the outer enclosure which is opposite that of the fluid reservoir 116, to provide the container section 24 which defines a sealed, fluid reservoir 114.

The partition 108 is spaced apart from the sidewalls 20 and the partitions 104 and 106, such that the container section 28 is defined therebetween, with the container section 22 extending interiorly within the container section 28. The container section 28 provides a sealed, fluid reservoir 118. Preferably, fresh water is provided for use as a cleaning fluid within the reservoir 118. The reservoirs 112, 114 and 116 contain cleaning fluid solutions for cleaning respective ones of golf club faces, golf balls and golf shoes. The cleaning fluid within the fluid reservoir 118 passes through the stopper valve fitting 38 for moistening a towel. The stopper valve fitting 38 is shown extending through the sidewall 20, from the reservoir 118 to the exterior of the enclosure 14. The stopper valve 48 is disposed within the stopper valve fitting 38 for selectively actuating to release the cleaning fluid from within the reservoir 118.

Figure 6:
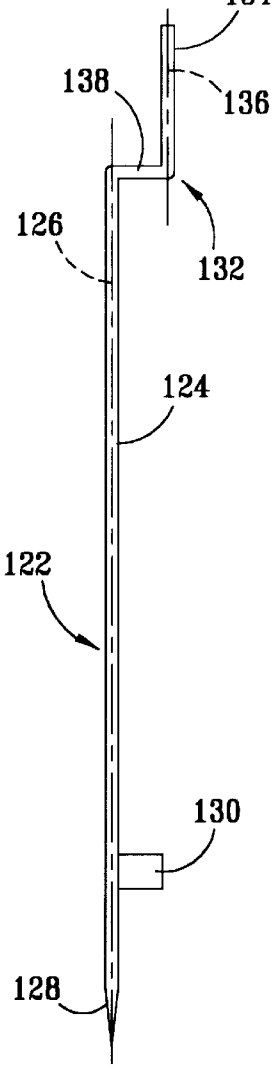
FIG. 6 illustrates a side, elevational view of mounting post for use with the multigolf cleaner according to present invention.

Referring now to FIG. 6, there is illustrated a side elevational view of the portable mounting post 122, which provides a portable stand for mounting the multigolf cleaner 12 of the present invention for use by a golfer on a course or at a driving range. Preferably, the portable mounting post 122 may be stowed within a golf bag with a golfer's clubs. The mounting post 122 has an elongated shaft 124 with a central longitudinal axis 126. The elongated shaft 124 has a tapered lower end 128, which preferably extends to a point to aid in insertion of the lower portion of the elongated shaft 124 through turf and into the ground soil beneath the turf. A foot stop 130 defines a protuberance which extends laterally outward from the side of the elongated shaft 124 for a user to step on for pressing the tapered lower end 128 downward through the turf and into the ground. The foot stop 130 also is spaced above the terminal end of the lower end 128 a predetermined distance to provide a stop for preventing of insertion of the lower end 128 of the elongated shaft 124 further into the ground once the shaft 124 is inserted the predetermined distance into the ground.

The mounting post 122 further includes an upper mounting portion 132. The upper mounting portion 132 includes a mounting post 134 having a central longitudinal axis 136. The upper mounting portion 132 also includes a cross member 138 which defines a ledge. The mounting post 134 is separated from the elongated shaft 124 by the cross member 138, such that the longitudinal axis 126 is spaced apart form the longitudinal axis 136 and a ledge provides a shelf of an adequate length for resting the bottom 18 of the outer enclosure 14 of the multigolf cleaner 12 thereon (shown in FIG. 1), such that the longitudinal axis 126 is offset from the longitudinal axis 136. Preferably, the outer enclosure 14 of the multigolf cleaner 12 is mounted upon the mounting post 122 by insertion of the mounting post 134 through the hole 66 (shown in FIG. 2) of the mounting bracket 60 until the bottom 18 (shown in FIG. 1) of the outer enclosure 14 rests upon the upward facing surface which defines the ledge of the cross member 138. The multigolf cleaner 12 of the present invention is mounted upon the mounting post 122 to provide a portable cleaning station which may be separately mounted from a golf bag, preventing moisture and debris from being attached to the golf bag as a result of cleaning the golfing equipment close to the golf bag.

Figure 7:
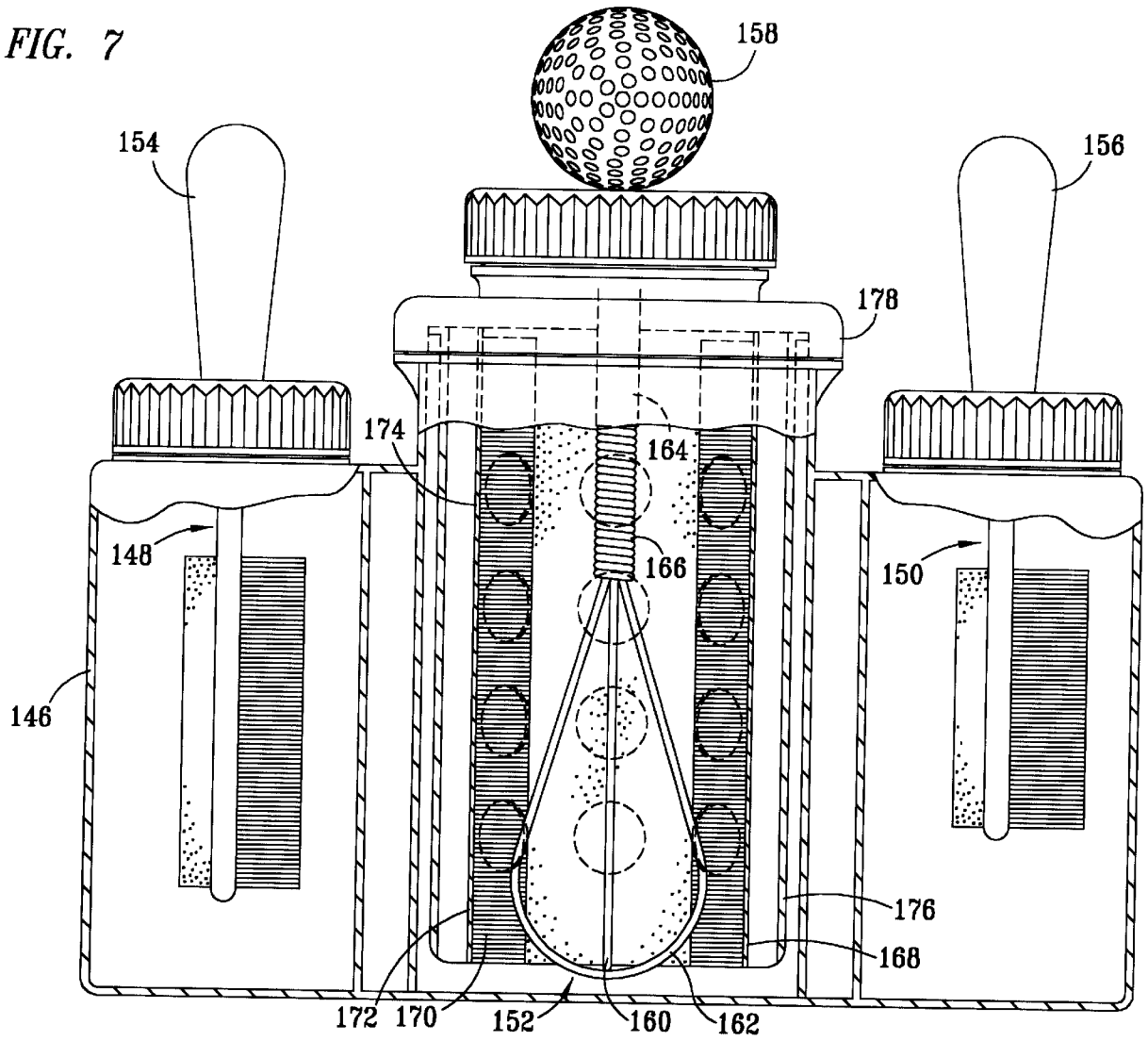
FIG. 7 illustrates an elevational sectional view of a multigolf cleaner of an alternative embodiment of the present invention.

Referring now to FIG. 7, there is illustrated an alternative embodiment 146 of a multigolf cleaner of the present invention. The cleaning utensils 148, 150 and 152 each have grip means defined by handles 154, 156 and 158, respectively. The handles 154 and 156 are of a different configuration than that of the handles 54 and 56 of the multigolf cleaner 12. The cleaning utensil 152 provides a ball washing fixture which has two elongated hoops 160 and 162 which are angularly spaced apart from one another at a 90.0 degree angular rotation, within a horizontal plane. The two elongated wire hoops 160 and 162 downwardly extend from a shaft 164, and a sleeve 166 provides a movable collar for moving downward upon the shaft 164 to urge the elongated wire hoop portions 160 and 162 in a radially inward direction. A removable cylinder 168 has brushes 170 which extend radially inward from a sidewall thereof for engaging a golf ball as it is upwardly and downwardly reciprocated within the central reservoir of the golf cleaner 146. Preferably, a plurality of circulation holes 174 extend through the sidewall of the cylinder 168, so that debris will pass through the holes 174 and remain on the rearward side of the cylinder 168 in a particulate trap defined between the cylinder 168 and an inward wall of the central reservoir. The cylinder 168 is mounted within a removable cylinder 176. The cylinder 176 is removable from within the central reservoir of the golf cleaner 146. A threaded cap 178 engages an upwardly extending threaded collar for securing the cylinder 176 and cylinder 168 within the multigolf cleaner 146. The ball washing fixture 152 is removed from within the enclosure of the alternate embodiment 136, and golf ball is placed within the lower end of the fixture 152. The fixture 152 and the golf ball are then inserted into the fluid compartment and reciprocated in upward and downward directions to pass the brushes 170 along the side of the golf ball to clean the golf ball.

The present invention provides several advantages over prior art golf equipment cleaners. A multigolf cleaner is provided having an outer enclosure within which there are several container sections defining fluid reservoirs. Two of the container sections have cleaning utensils with integral sealing caps for sealing respective ones of the fluid reservoirs. The cleaning utensils have brushes mounted to the lower ends thereof. The brushes are inserted within cleaning solutions disposed within the fluid reservoirs, and the sealing caps of the cleaning utensils are threadingly secured to upper portions of the respective container sections to seal the fluids reservoirs. A third cleaning utensil provides a ball washing fixture which may be used for reciprocating a golf ball upwards and downwards within a cleaning solution against a third plurality of brush bristles to dislodge debris and dirt therefrom. A cleaning fluid reservoir is provided for storing a fluid for later use to moisten a cleaning towel. The cleaning towel has a clip for engaging a towel clip bracket which is mounted to the exterior surface of the multigolf cleaner. The outer enclosure of the multigolf cleaner has a mounting bracket such that multigolf cleaner can be readily mounted to the rim of a golf bag. The mounting bracket of the multigolf cleaner includes golf tee retaining holes for securing golf tees until the golf tees are desired for use. A portable mounting post provides a stand for mounting the multigolf cleaner thereto when it is desired to use the multigolf cleaner remote from a golf bag.

Although the preferred embodiment has been described in detail, it should be understood that various changes, substitutions and alterations can be made therein without departing from the spirit and scope of the invention as defined by the appended claims.

What is claimed is:

1. An apparatus for cleaning golf equipment, comprising:

an enclosure having interior and exterior surfaces, and openings which extend through said interior and exterior surfaces;

partitions extending within said enclosure to define four separate fluid reservoirs, wherein a first one of said fluid reservoirs is disposed within a second one of said fluid reservoirs, and said second one of said fluid reservoirs is defined, at least in part, by said interior surface of said enclosure;

each of said openings in said enclosure corresponding to one of said fluid reservoirs, and three of said openings each having a mounting section for engaging with respective ones of three caps for mounting said caps thereto to seal three of said reservoirs;

said three caps for sealing respective ones of said openings, one of said caps having a ball washing fixture and the other two of said caps having brush type cleaning utensils;

a water valve connected to a fourth one of said openings for selectively operating to control a liquid flow from within a corresponding one of said reservoirs;

brush bristles mounted interiorly within one of said reservoirs, facing radially inward in an alignment for engaging against the exterior surface of a golf ball being retained within said ball washing fixture as said ball washing fixture is operatively moved to move the golf ball within said one of said reservoirs; and grip means defined for each of said caps, on an opposite side of said respective ones of said three caps from respective ones of said ball washing fixture and said cleaning utensils.

2. The apparatus according to claim 1, further comprising:

a mounting bracket having a support member portion and a retaining portion for engaging a rim and a sidewall of a golf bag to secure said mounting bracket to the golf bag, with said support member portion engaging the rim of said golf bag and said retaining portion engaging the sidewall of the golf bag.

3. The apparatus according to claim 2, further comprising:

said mounting bracket further including a tee retaining portion having a plurality of apertures for storing the tees therein;

said support member portion of said mounting bracket having a hole extending therethrough for passage of a mounting post; and said mounting post having a lowermost section which has a pointed lower end, an intermediate section having a foot stop extending laterally outward from a lower end portion thereof, and an upper section which defines a ledge for supporting a lower facing portion of said periphery of said enclosure and which extends upward from said ledge for engaging within said hole of said mounting bracket such that said upper section is retained within said hole.

4. The apparatus according to claim 1, further comprising:

a towel clip bracket for engaging a clip thereto to exteriorly secure a towel to said enclosure.

5. The apparatus according to claim 1, further comprising:

a flexible sheet having first and second sides, and a thickness which extends therebetween, said first side having said brush bristles mounted thereto for extending in from said thickness and radially inward within the said one of said reservoirs within which the golf ball and said ball washing fixture are operatively moved for washing the golf ball.

6. The apparatus according to claim 5, further comprising:

a plurality of spacers which extend radially outward of said flexible sheet, and between said flexible sheet and said ones of said partitions and said interior surfaces of said enclosure which define said one of said reservoirs within which the golf ball and said ball washing fixture are operatively moved for washing the golf ball; and said flexible sheet having a plurality of holes which are spaced apart in two directions across said flexible sheet, and which extending through a thickness of said flexible sheet for passing fluid therethrough for passing debris cleaned from the golf ball into a spaced defined radially outward from said flexible sheet by said spacers.

7. The apparatus according to claim 6, wherein said plurality of spacers are integrally formed, as one piece with said flexible sheet, and said flexible sheet is formed with four separate edges which are not joined to one another.

8. The apparatus according to claim 1, further comprising:

a club holder member defined to extend from said enclosure, and having a plurality of notches formed into an edge thereof, such that said club holder and said enclosure are mounted with said notches spaced apart from the ground surface for receiving the upper portions of golf clubs to retain said golf clubs in an upright position.

9. An apparatus for cleaning golf equipment, comprising:

an enclosure having interior and exterior surfaces, and openings which extend through said interior and exterior surfaces;

partitions extending within said enclosure to define separate fluid reservoirs;

each of said openings in said enclosure corresponding to one of said fluid reservoirs, and a portion of said openings each having a mounting section for engaging with respective ones of sealing members to seal said portions of said reservoirs;

said sealing members for sealing respective ones of said openings, one of said sealing members having a ball washing fixture and at least one other of said sealing members having a brush cleaning utensil;

brush bristles mounted interiorly within one of said reservoirs, facing radially inward in an alignment for engaging against the exterior surface of a golf ball being retained within said ball washing fixture as said ball washing fixture is operatively moved to move the golf ball within said one of said reservoirs; and a flexible sheet having first and second sides, and a thickness which extends therebetween, said first side having said brush bristles mounted thereto for extending radially inward within the said one of said reservoirs within which the golf ball and said ball washing fixture are operatively moved for washing the golf ball.

10. The apparatus according to claim 9, further comprising:

a plurality of spacers which extend radially outward of said flexible sheet, and between said flexible sheet and said interiors surfaces of said enclosure which define said one of said reservoirs within which the golf ball and said ball washing fixture are operatively moved for washing the golf ball; and said flexible sheet having a plurality of holes which are spaced apart in two directions across said flexible sheet, and which extending through a thickness of said flexible sheet for passing fluid therethrough for passing debris cleaned from the golf ball into a spaced defined radially outward from said flexible sheet by said spacers.

11. The apparatus according to claim 9, wherein said flexible sheet is formed with four separate edges which are not joined to one another.

12. An apparatus for cleaning golf equipment, comprising:

an enclosure having interior and exterior surfaces, and openings which extend through said interior and exterior surfaces;

partitions extending within said enclosure to define separate fluid reservoirs, wherein a first one of said fluid reservoirs is disposed within a second one of said fluid reservoirs, and said second one of said fluid reservoirs is defined, at least in part, by said interior surface of said enclosure;

each of said openings in said enclosure corresponding to one of said fluid reservoirs, and a plurality of said openings each having a mounting section for securing with respective ones of sealing members thereto;

said sealing members for sealing respective ones of said openings, one of said sealing members having a ball washing fixture and the other two of said sealing members having cleaning utensils;

brush bristles mounted interiorly within one of said reservoirs, facing radially inward in an alignment for engaging against the exterior surface of a golf ball being retained within said ball washing fixture as said ball washing fixture is operatively moved to move the golf ball within said one of said reservoirs;

a mounting bracket having a support member portion and a retaining portion for engaging a rim and a sidewall of a golf bag to secure said mounting bracket to the golf bag, with said support member portion engaging the rim of said golf bag and said retaining portion engaging the sidewall of the golf bag;

said support member portion of said mounting bracket having a hole extending therethrough for passage of a mounting post; and said mounting post having a lowermost section which has a pointed lower end, an intermediate section having a foot stop extending laterally outward from a lower end portion thereof, and an upper section which defines a ledge for supporting a lower facing portion of said periphery of said enclosure and which extends upward from said ledge for engaging within said hole of said mounting bracket such that said upper section is retained within said hole.

13. The apparatus according to claim 12, further comprising:

said mounting bracket further including a tee retaining portion having a plurality of apertures for storing the tees therein.

14. The apparatus according to claim 13, further comprising:

a towel clip bracket for engaging a clip thereto to exteriorly secure a towel to said enclosure.

15. An apparatus for cleaning golf equipment, comprising:

an enclosure having interior and exterior surfaces, and openings which extend through said interior and exterior surfaces;

partitions extending within said enclosure to define four separate fluid reservoirs, wherein a first one of said fluid reservoirs is disposed within a second one of said fluid reservoirs, and said second one of said fluid reservoirs is defined, at least in part, by said interior surface of said enclosure;

each of said openings in said enclosure corresponding to one of said fluid reservoirs, and three of said openings each having a cylindrically shaped section for threadingly engaging with respective ones of three threaded caps to seal three of said reservoirs;

said three threaded caps for sealing respective ones of said openings, one of said threaded caps having a ball washing fixture and the other two of said threaded caps having cleaning utensils;

a water valve connected to a fourth one of said openings for selectively operating to control a liquid flow from within a corresponding one of said reservoirs;

brush bristles mounted interiorly within one of said reservoirs, facing radially inward in an alignment for engaging against the exterior surface of a golf ball being retained within said ball washing fixture as said ball washing fixture is operatively moved to move the golf ball within said one of said reservoirs;

grip handles, one mounted to each of said three threaded caps, on an opposite side of said respective ones of said three threaded caps from respective ones of said ball washing fixture and said cleaning utensils; and a mounting bracket having a support member portion and a retaining portion for engaging a rim and a sidewall of a golf bag to secure said mounting bracket to the golf bag, with said support member portion engaging the rim of said golf bag and said retaining portion engaging the sidewall of the golf bag.

16. The apparatus according to claim 15, further comprising:

said mounting bracket further including a tee retaining portion having a plurality of apertures for storing the tees therein;

said support member portion of said mounting bracket having a hole extending therethrough for passage of a mounting post; and said mounting post having a lowermost section which has a pointed lower end, an intermediate section having a foot stop extending laterally outward from a lower end portion thereof, and an upper section which defines a ledge for supporting a lower facing portion of said periphery of said enclosure and which extends upward from said ledge for engaging within said hole of said mounting bracket such that said upper section is retained within said hole.

17. The apparatus according to claim 16, further comprising:

a towel clip bracket for engaging a clip thereto to exteriorly secure a towel to said enclosure.

18. The apparatus according to claim 17, further comprising:

a flexible sheet having first and second sides, and a thickness which extends therebetween, said first side having said brush bristles mounted thereto for extending from said thickness radially inward within the said one of said reservoirs within which the golf ball and said ball washing fixture are operatively moved for washing the golf ball.

19. The apparatus according to claim 18, further comprising:

a plurality of spacers which extend radially outward of said flexible sheet, and between said flexible sheet and said ones of said partitions and said interior surfaces of said enclosure which define said one of said reservoirs within which the golf ball and said ball washing fixture are operatively moved for washing the golf ball; and said flexible sheet having a plurality of holes which are spaced apart in two directions across said flexible sheet, and which extending through a thickness of said flexible sheet for passing fluid therethrough for passing debris cleaned from the golf ball into a spaced defined radially outward from said flexible sheet by said spacers.

20. The apparatus according to claim 19, further comprising:

a plate having a plurality of notches formed into an edge thereof, an aperture for receiving said mounting post, and an upper surface for fitting beneath said enclosure with said plate spaced apart from the ground surface and said notches positioned for receiving the upper portions of golf clubs to retain said golf clubs in an upright position.

21. An apparatus for cleaning golf equipment, comprising:

an enclosure having interior and exterior surfaces, and openings which extend through said interior and exterior surfaces;

partitions extending within said enclosure to define separate fluid reservoirs;

said openings in said enclosure corresponding to said fluid reservoirs, and a portion of said openings each having a mounting section for engaging with respective ones of sealing members to seal said portions of said reservoirs;

sealing members for sealing respective ones of said openings;

a mounting bracket mounted to said enclosure for securing said enclosure to at least one of a mounting post and a sidewall of a golf bag, such that said enclosure is spaced apart from a ground surface; and a club holder member defined to extend from said enclosure, and having a plurality of recesses formed into an edge thereof, such that said club holder and said enclosure are mounted with said recesses disposed above and spaced apart from the ground surface for receiving the upper portions of golf clubs to retain the golf clubs in an upright position.

22. The apparatus according to claim 21, wherein said mounting post has a lowermost section which has a pointed lower end, an intermediate section having a foot stop extending laterally outward from a lower end portion thereof, and an upper section which defines a ledge for supporting a lower facing portion of a periphery of said enclosure and which extends upward from said ledge for engaging within a hole of said mounting bracket and an aperture in said club holder member, such that said mounting bracket, said enclosure and said club holder are slidably secured to said mounting post.

23. The apparatus according to claim 22, wherein said club holder member comprises a plate having a plurality of notches formed into an edge thereof to define said recesses, an aperture for receiving said mounting post, and an upper surface for fitting beneath said enclosure with said plate spaced apart from the ground surface and said notches positioned for receiving the upper portions of golf clubs to retain said golf clubs in an upright position.

24. The apparatus according to claim 23, further comprising:

said sealing, members for sealing respective ones of said openings, one of said sealing members having a ball washing fixture and at least one other of said sealing members having a brush cleaning utensil; and brush bristles mounted interiorly within one of said reservoirs, facing radially inward in an alignment for engaging against the exterior surface of a golf ball being retained within said ball washing fixture as said ball washing fixture is operatively moved to move the golf ball within said one of said reservoirs.

* * * * *